United States Patent [19]

Hamamura et al.

[11] Patent Number: 4,942,098

[45] Date of Patent: Jul. 17, 1990

[54] CORROSION RESISTANT PERMANENT MAGNET

[75] Inventors: Atsushi Hamamura, Kyoto; Takaki Hamada; Hiroko Nakamura, both of Takatsuki; Tomoyuki Imai, Hiroshima; Toshiki Matsui, Hiroshima; Nanao Horiishi, Hiroshima, all of Japan

[73] Assignees: Sumitomo Special Metals, Co., Ltd., Osaka; Toda Kogyo Corp., Hiroshima, both of Japan

[21] Appl. No.: 172,395

[22] Filed: Mar. 24, 1988

[30] Foreign Application Priority Data

| | | | |
|---|---|---|---|
| Mar. 26, 1987 | [JP] | Japan | 62-73920 |
| Apr. 13, 1987 | [JP] | Japan | 62-90045 |
| Apr. 13, 1987 | [JP] | Japan | 62-90046 |
| Apr. 23, 1987 | [JP] | Japan | 62-100980 |
| Apr. 23, 1987 | [JP] | Japan | 62-100981 |
| Nov. 26, 1987 | [JP] | Japan | 62-297975 |

[51] Int. Cl.[5] ..... B22F 7/04

[52] U.S. Cl. ..... 428/555; 428/558; 428/611; 428/928; 148/122; 148/102; 148/302; 148/303; 148/310; 148/311; 252/62.55

[58] Field of Search ..... 428/555, 558, 611, 928; 148/302, 303, 310, 311, 122, 102; 252/62.55

[56] References Cited

U.S. PATENT DOCUMENTS 3,591,428 11/1968 Buschew et al. ..... 148/31.57

FOREIGN PATENT DOCUMENTS 0101552 2/1984 European Pat. Off. .
0106948 5/1984 European Pat. Off. .
0134304 3/1985 European Pat. Off. .
0022804 6/1978 Japan ..... 148/303

OTHER PUBLICATIONS

Japanese Patent Kokai Publication No. 59-64733, Apr. 12, 1984.
Japanese Patent Kokai Publication No. 59-132104, Jul. 30, 1984.
Japanese Patent Kokai Publication No. 59-89401, May 23, 1984.
Japanese Patent Kokai Publication No. 59-46008, Mar. 15, 1984.
Japanese Patent Kokai Publication No. 60-34005, Feb. 21, 1985.
Japanese Patent Kokai Publication No. 60-54406, Mar. 28, 1985 (English abstract attached).

*Primary Examiner*—Stephen J. Lechert, Jr.
*Assistant Examiner*—Ngoclan Mai
*Attorney, Agent, or Firm*—Wegner & Bretschneider

[57] ABSTRACT

To obtain an anticorrosive Fe-B-R type permanent magnet; in particular, to reduce deterioration rate of the initial magnetic properties below 10% after the magnet has been kept at 80° C. in 90% relative humidity for 500 hours, the surface of the sintered permanent magnet is coated with metallic coating film layers of at least one noble metal layer and at least one base metal layer disposed on the noble metal layer. Diffusion heat treatment further improves the adhesiveness of the coating film layers.

14 Claims, 3 Drawing Sheets

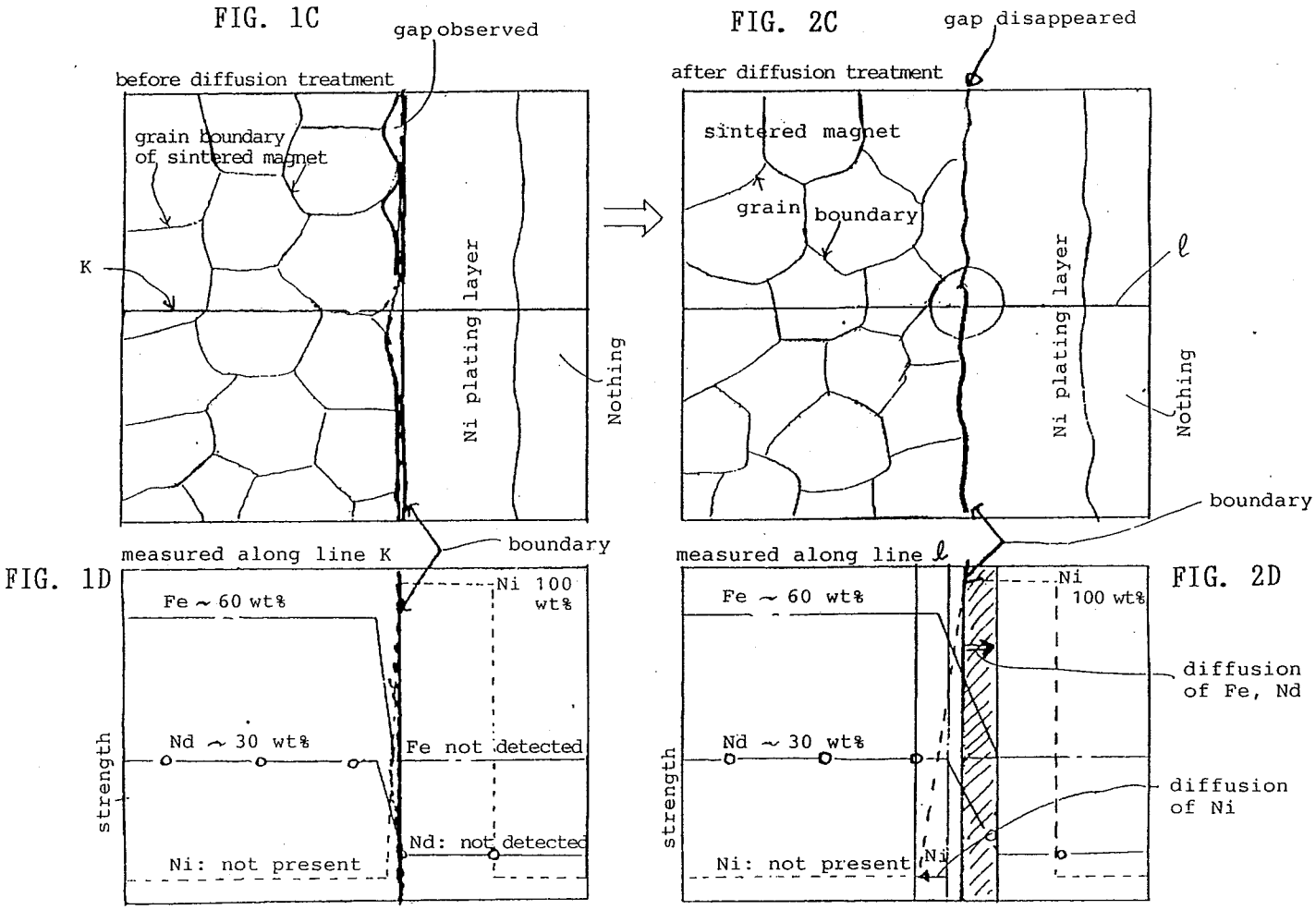
FIG. 1C
before diffusion treatment
gap observed
grain boundary of sintered magnet
Ni plating layer
Nothing
K
FIG. 1D
measured along line K
Fe ~ 60 wt%
Nd ~ 30 wt%
Ni: not present
Ni 100 wt%
Fe not detected
Nd: not detected
strength
boundary
FIG. 2C
after diffusion treatment
gap disappeared
sintered magnet
grain boundary
Ni plating layer
Nothing
ℓ
FIG. 2D
measured along line ℓ
Fe ~ 60 wt%
Nd ~ 30 wt%
Ni: not present
Ni 100 wt%
diffusion of Fe, Nd
diffusion of Ni
strength
boundary

CORROSION RESISTANT PERMANENT MAGNET

DEFINITION

In the present application the symbol "R" generally represents rare earth elements which include Y.

BACKGROUND

The present invention relates to an Fe-B-R type permanent magnet with excellent magnetic properties and high corrosion resistance, and more specifically to a Fe-B-R type permanent magnet stable in magnetic properties; in particular, small in deterioration rate from the initial magnetic properties after having been kept in an atmosphere of a temperature of 80° C. and a relative humidity of 90% for many hours. The present invention also relates to a process for producing such magnet.

Permanent magnets of Fe-B-R types have been proposed as novel high-performance permanent magnets, which have magnetic properties beyond the maximum properties of the conventional rare earth-cobalt magnets and contain as the main components Fe, abundant light rare earth elements such as Nd and/or Pr and boron (B), without containing expensive elements Sm or Co (Japanese Patent Kokai-Publication Nos. 59-46008 and 59-89401 or corresponding EPA 101552).

The Curie temperature of the abovementioned magnetic alloy lies in general within a range of 300° to 370° C. However, when part of Fe is substituted with Co, it is possible to obtain an Fe-B-R type permanent magnet with a higher Curie temperature (Japanese Patent Kokai-Publication Nos. 59-64733 and 59-132104 or corresponding EPA 106948). Further, when part of R of the Fe-B-R type rare-earth permanent magnet containing Co and light rare-earth elements Nd and/or Pr as R is substituted with at least one of heavy rare-earth elements such as Dy, Tb, Ho, etc., it is possible to obtain a Co-containing Fe-B-R type rare-earth permanent magnet having a Curie temperature equal to or higher than the aforementioned Co-containing Fe-B-R type rare-earth permanent magnet, a high (BH) max beyond 25 MGOe and an improved temperature dependency, in particular, an improved iHc (Japanese Patent Kokai-Publication No. 60-34005, EPA 134304).

Although permanent magnets of the Fe-B-R type magnetic anisotropic sintered body have excellent magnetic properties, however, since these magnets contain as the main components rare-earth elements and iron readily oxidized in air into stable oxides, when used as magnetic circuit, results in the deterioration and fluctuation in magnetic characteristics of the magnetic circuits, and contaminates other peripheral devices due to oxides peeled off from the surface of the magnet.

To improve the corrosion resistance of the abovementioned Fe-B-R type permanent magnet, it has been proposed that the surface of the permanent magnet with an corrosion-resistant metallic film layer formed by electroless plating or electrolytic plating (Japanese Patent Kokai-Publication No. 58-162350). In this plating method, since the permanent magnet is of a sintered body having certain amount of pores, there exists another problem in that an acid or alkaline solution for pre-plating treatment resides within these pores and therefore the magnet material (sintered) body is corroded with the lapse of time. Further, since the magnet material body is poor in chemical resistance, there exists other problem in that the surface of the magnet material body is corroded in plating treatment and therefore the surface adhesive strength and the corrosion resistance of the plating layer are both not sufficient.

To overcome the abovementioned problems, it has been proposed a method of forming a metallic thin film on the surface of the sintered magnet material body by vapor plating to improve the corrosion resistance of the above Fe-B-R type permanent magnet (Japanese Patent Kokai-Publication Nos. 61-150201, 61-166115, 61-166116 and 61-166117 or corresponding U.S. Ser. No. 818,238 or EPA 0190461).

In these magnets, although the corrosion resistance of the Fe-B-R type permanent magnet can be improved, since the coated metal particles are deposited only on the surface of the magnet material body the adhesive strength is not sufficiently high. In particular, at the corners of a magnet body, the adhesive strength of the metallic particles is not uniform and therefore not high, thus resulting in various problems such as local thin film peeling off, local crack formation, local rust formation, when exposed to a severe environment for a long period of time.

On the other hand, with respect to the abovementioned Fe-B-R type permanent magnet whose surface is plated, since the permanent magnet body is a sintered body with pores the adhesive strength and the corrosion resistance are both poor. Further, the initial magnetic properties deteriorates by more than 10% after the magnet has been exposed at 60° C. in an atmosphere of a relative humidity (R.H.) of 90% for 100 hours for corrosion test, thus indicating that the stability is not sufficient. Therefore there is much to be desired in the art.

SUMMARY OF THE DISCLOSURE

It is a primary object of the present invention to improve the corrosion resistance of the Fe-B-R type permanent magnets and to provide a low-priced Fe-B-R type permanent magnet with stable high magnetic properties which can reduce deterioration from the initial magnetic properties particularly after having been exposed to an atmosphere of 80° C. and 90% (R.H.) for a prolonged period of time.

It is a further object of the present invention to provide a low-priced Fe-B-R type permanent magnet with high stable magnetic properties and without peeling-off of the oxidation resistant film, even after having been exposed to an atmosphere of 125° C. and 85% (R.H.) for a long period of time (under PCT test conditions).

As a result of various researches for surface treatments of the permanent magnet material bodies in order to obtain Fe-B-R type permanent magnets with stable magnetic properties even after having been exposed to a severe atmosphere (at 80° C., 90% relative humidity) for a long period of time, the inventors have found that it is possible to obtain a Fe-B-R type sintered magnet with excellent corrosion resistance and stable magnetic properties by coating the surface of the magnet material body with a metallic layer formed of a noble metal and a base metal, particularly of a noble metal film layer and a further base metal film layer coated on the noble metal film layer.

The above mentioned object can be achieved by the following means.

According to a first aspect of the present invention, a corrosion-resistant permanent magnet comprising a sintered body consisting essentially of 10 to 30 atomic % R wherein R is at least one element selected from the group consisting of Nd, Pr, Dy, Ho and Tb or a mixture of said at least one element and at least one selected from the group consisting of La, Ce, Sm, Gd, Er, Eu, Tm, Yb, Lu and Y, 2 to 28 atomic % B and 65 to 80 atomic % Fe; and having a major phase of a tetragonal crystal structure; the surface of the sintered body being coated with a noble metal film layer consisting essentially of at least one noble metal selected from the group consisting of Pd, Ag, Pt, Au and alloys thereof and a base metal film layer, disposed on said noble metal layer, consisting essentially of at least one base metal selected from the group consisting of Ni, Cu, Sn, Al, Cr, Zn, Co and alloys thereof; said corrosion resistant permanent magnet being characterized by a deterioration rate of the initial magnetic properties thereof being 10% or less after having been kept at a temperature of 80° C. in a relative humidity of 90% for 500 hours.

According to a second aspect of the present invention, the magnet as set forth as the first aspect further includes interdiffusion layers which are formed between the base metal film layer and the sintered body; and the magnetic properties thereof are still stable after the magnet material body has been kept at a temperature of 125° C. in a relative humidity of 85% for 12 hours.

According to a third aspect of the present invention, there is provided a process for producing a corrosion-resistant permanent magnet, comprising:

providing a sintered body comprising 10 to 30 atomic % R wherein R is at least one element selected from the group consisting of Nd, Pr, Dy, Ho and Tb or a mixture of said at least one element and at least one selected from the group consisting of La, Ce, Sm, Gd, Er, Eu, Tm, Yb, Lu and Y, 2 to 28 atomic % B and 65 to 80 atomic % Fe, and having a major phase of a tetragonal crystal structure;

coating the surface of the sintered permanent magnet body with a noble metal film layer consisting essentially of at least one metal selected from the group consisting of Pd, Ag, Pt, Au and alloys thereof; and coating said noble metal film layer with a base metal layer consisting essentially of at least one metal selected from the group consisting of Ni, Cu, Sn, Al, Cr, Zn, Co and alloys thereof.

According to a fourth aspect of the present invention, the process as set forth as the third aspect further comprises the step of diffusion treating the coated sintered body within a non-oxidizing atmosphere at 400° to 700° C. for such a sufficient period of time to form interdiffusion layers between the base metal film layer and the sintered body.

It is not clear the reason why the Fe-B-R type permanent magnet coated with the metallic film layers according to the present invention is stable in magnetic properties, in particular, small in the deterioration from the initial magnetic properties under severe atmosphere conditions.

However, it has been confirmed that in the Fe-B-R type sintered magnets coated with a metallic film layer consisting essentially of at least one base metal selected from the group consisting of Ni, Cu, Sn and Co by means of electro-plating, the magnetic properties are unstable and deteriorate under severe corrosion test conditions such as at temperature 60° C. in a relative humidity of 90%, and for a test time of 100 hrs. In contrast to this, in the case of the magnet according to the present invention, it has been clarified that the metallic coating film layers are extremely fine, so that it is possible to perfectly protect the permanent magnet from change in the external environment by moisture, gases or the like.

In the Fe-B-R type permanent magnet of the present invention, the deterioration in magnetic properties is no more than 10% of the initial magnetic properties under the severe corrosion test conditions such as at temperature 80° C., in the relative humidity of 90% for the test time of 500 hrs. Therefore, this permanent magnet can be employed as a low-priced high performance permanent magnet.

Further, when the magnet is used in a magnetic circuit of a motor, since the permanent magnet is assembled by bonding and further a torque load is often applied to the permanent magnet, a certain bonding strength test is necessary in general.

Recently, permanent magnets incorporated in electronic devices such as integrated circuit boards are required to satisfy corrosion resistance tests such as an atmosphere test (kept at 80° C. in a 90% relative humidity for many hrs), or a PCT test (kept at 125° C. in 85% R.H. for many hours).

According to the second and fourth aspect of the present invention, since there exists no deterioration in the adhesive strength of the anticorrosive film layer made of metallic coating layers even after the magnet has been exposed to an atmosphere at 125° C. in 85% R.H. for 12 hours, it is possible to obtain a highly stable practical Fe-B-R type permanent magnet.

That is to say, after the surface of the sintered magnetic material body has been coated with a noble metal coating film layer consisting essentially of at least one noble metal selected from the group consisting of Pd, Ag, Pt and Au, and a base metal coating film layer of at least one base metal selected from the group consisting of Ni, Cu, Sn, Co, etc., the permanent magnet is heat-treated for interdiffusion. Therefore, elements of the metallic coating film layers and the substrate (sintered body) are interdiffused into each other; that is, the elements of the base metal film layer (Ni, Cu, Sn, Co, etc.) are diffused in the sintered magnet material body (Fe, R such as Nd) or vice versa. The elements of the noble metal film layer (Pd, Ag, Pt, Au, etc.) coated on the surface of the sintered body is believed to be diffused in the base metal film layer and the sintered body layer. However, the diffused layer is very thin so as to be difficult to be detected by the X ray Micro Analyzer. As a result, the metallic coating film layers are allowed to be extremely fine and therefore the adhesive strength of the metallic film layers can be improved, thus it is possible to more perfectly protect the permanent magnet from change in the external environment by moisture and gases.

BRIEF DESCRIPTION OF THE DRAWING

FIGS. 1A–1D and FIGS. 2A–2D show the interdiffusion state along a cross-section of an embodiment of the present invention by X-ray Micro Analyzer (×1800) before and after a diffusion heat treatment.

PREFERRED EMBODIMENTS

Figure 2A:
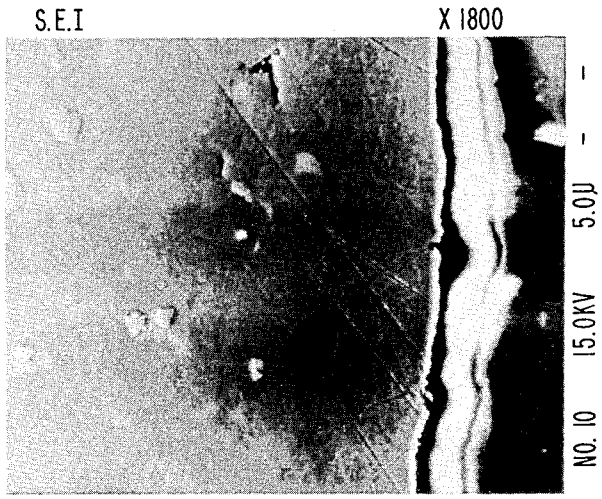
Figure 1A:
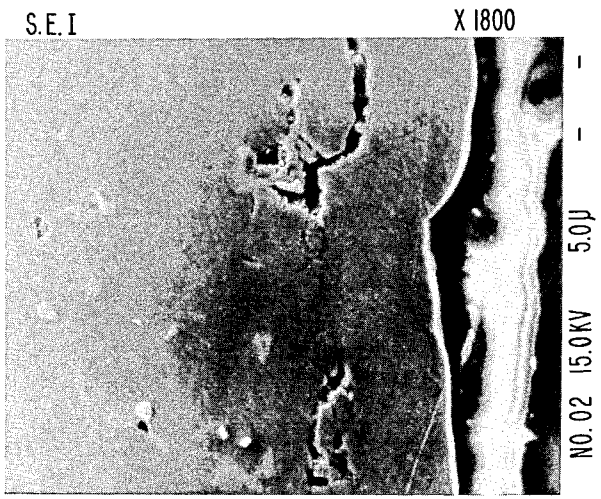
Figure 2B:
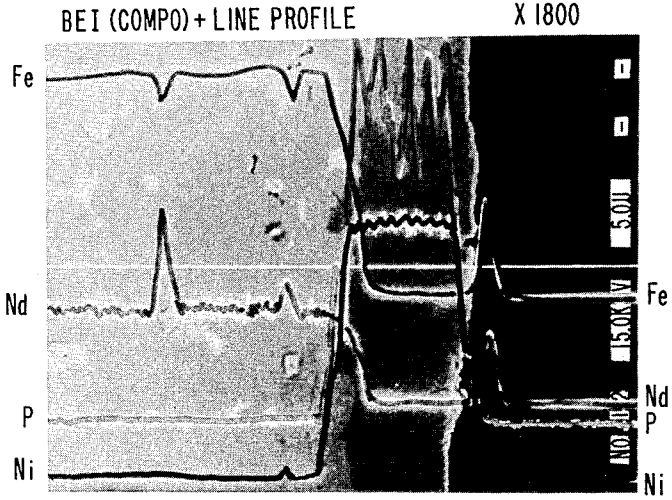
Figure 1B:
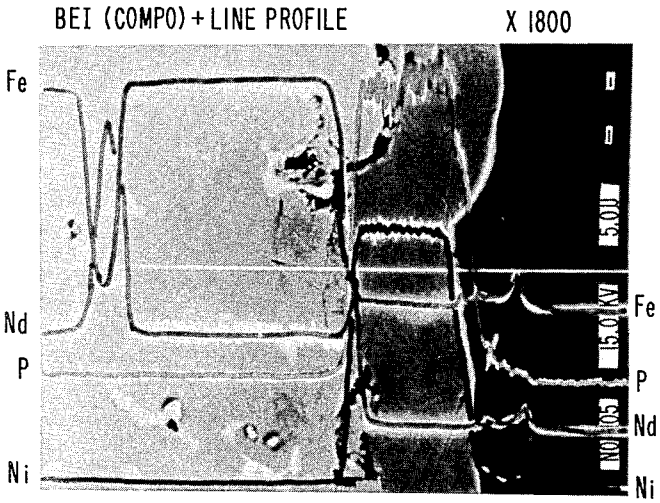

In the present invention, the noble metal film layer coated on the surface of the sintered magnet material body and consisting of at least one noble metal element selected from Pd, Ag, Pt, Au, etc. may be formed when colloids of the noble metal dispersed in a non-aqueous solvent or an aqueous solvent are absorbed (or adsorbed) onto the magnet surface. Further, the noble metal film layer can be coated by vapor deposition such as vacuum deposition ion sputtering or ion plating, e.g., under a vacuum of $5\times10^{-2}$ to $1\times10^{-7}$ Torr. Further, the thickness of the noble metal film layer is preferably 10 to 100 angstroms.

Further, in the present invention, the base metal film layer consisting of at least one element selected from Ni, Cu, Sn, Co, etc. may be coated by electroless plating or the like. The thickness of the base metal film layer is preferably 25 μm or less, and more preferably from 3 to 20 μm.

Further, the preferable non-aqueous solvent for the colloid absorption is volatile solvents, e.g., hydrocarbon (aromatic) such as benzene, toluene, xylene, etc.; halogenized hydrocarbon such as trichlorotrifluoroethane, chloroform, trichloroethane, etc.; aliphatic ester group such as ethyl acetate, etc.; or ketone group such as methyl ethyl ketone.

The absorption method may be conducted as follows: The sintered body is dipped in a non-aqueous solvent in which aforementioned noble metal colloids are dispersed, or a non-aqueous volatile solvent in which the aforementioned noble metal colloids are dispersed is applied onto the sintered body by a known coating manner like brushing or spraying. After the absorption, the solvent is removed by evaporation (e.g., drying with heat, evacuation, etc.), if necessary, depending upon the subsequent steps.

Further, as is mentioned previously, the noble metal film layer coated on the surface of the sintered magnet material body can be formed by the known vapor deposition technique.

The noble metal film layer coated on the surface of the sintered body may be formed when noble metal colloids dispersed in a neutral solvent of pH 6.0 to 9.0 are absorbed onto the sintered body surface. In this case, the thickness of the noble metal film layer is preferably 10 to 100 angstroms, too. As the neutral solvent, volatile solvents such as those herein-above mentioned are preferred, however, aqueous solution may be used.

Further, as the neutral solvent in which the noble metal colloids are dispersed, a solution in which noble metal (e.g., 0.01 to 0.5% by weight) of a 10 or more (preferably 20–50) angstroms particle size is uniformly dispersed is used. Such colloidal solution can be obtained by reducing noble metal salt (e.g., chloride of Pd, Pt or Au or nitrate of Ag) with a water soluble reducing agent (e.g., tin chloride, hydrazine) in the presence of water soluble dispersion agent.

As the above water soluble dispersion agent, it is possible to use surfactant, or water soluble polymers.

The pH of the neutral solvent is preferably 6.0 to 9.0. If less than pH 6.0, the surface of the sintered magnet material body is readily corroded. If more than pH 9.0, it is impossible to obtain a solvent in which noble metal is stably dispersed. The liquid medium may be water or a mixture of water and alcohol.

In summary, the noble metal film layer coated on the surface of the sintered magnet material body can be formed by means of known vapor deposition technique such as vacuum deposition, ion sputtering, ion plating, etc. or by absorption of noble metal colloid onto the sintered body surface in a non-aqueous solvent or a neutral solvent of a specific pH value. Before this absorption step, a chemically and thermally stable inorganic substance may be absorbed in the colloidal state, such inorganic substance includes oxides of metal such as Al, Si or the like. The particle size may be in the same range as the noble metal colloid. This preabsorption layer serves to close large pores on the surface of the sintered body thus to reduce the consumption of noble metal and resulting in improved adhesiveness. This preabsorption may be conducted in the similar manner as the noble metal absorption.

In the present invention, the base metal film layer or the base metal alloy layer consisting of at least one element selected from Ni, Cu, Sn, Al, Cr, Zn and Co may be formed by vapor deposition technique such as vacuum deposition, ion sputtering, or ion plating; or electroless (chemical) plating for Ni, Cu, Co or Sn. The vapor deposition may be done, e.g., in a vacuum of $5\times10^{-2}$ to $1\times10^{-7}$ Torr.

The feature of the fourth aspect resides in the diffusion heat treatment. The diffusion heat treatment is effected within a vacuum or an inert atmosphere or a reducing atmosphere (i.e., nonoxidizing atmosphere) preferably at a heating temperature 400° to 700° C. for 0.5 to 2 hours. This is because if lower than 400° C., 5 hours or longer heating is required to improve adhesive strength, and if higher than 700° C., coercive force iHc of the magnetic properties decreases unpreferably. Further, the temperature of the diffusion heat treatment lies preferably within a range of 500° to 600° C.

The above diffusion heat treatment can be effected simultaneously with or after aging treatment for the sintered magnet material body.

The rare earth element(s) R used in the sintered permanent magnet material bodies of the present invention amounts to 10–30 atomic % of the overall composition wherein R represents at least one of Nd, Pr, Dy, Ho and Tb or a mixture of at least one of said five and at least one of La, Ce, Sm, Gd, Er, Eu, Tm, Y, Lu and Y. Usually, it suffices to use one of said five R, but use may be made of mixtures of two or more R (mischmetal, didymium, etc.) for the reasons of their easy availability, etc. For higher performance and in view of cost or resources, at least 50 atomic % of the overall R should be Nd and/or Pr. Nd is most preferred as the main element of R.

It is noted that R may not be pure rare earth elements, but may contain impurities to be inevitably entrained from the process of production, as long as they are industrially available.

The defined R is an element or elements inevitable in the novel permanent magnet materials. However, in an amount of below 10 atomic % it is impossible to obtain permanent magnets having high magnetic properties, in particular high coercive force, since a cubic system crystal structure which is the same structure as alpha-iron biginns to occur. In an amount of higher than 30 atomic % R, on permanent magnets are obtained, since the proportion of R-rich nonmagnetic phases is increased in the sintered body, resulting in a drop of residual magnetic flux density (Br). Therefore, the amount of the rare earth element(s) is limited to a range of 10–30 atomic %. Preferably R is 12–20 atomic %, or more preferably 12–17 atomic % for higher or highest performance and corrosion resistance.

B (boron) is an inevitable element in the permanent magnet of this invention. However, in an amount of lower than 2 atomic % it is impossible to obtain permanent magnets having high coercive force (iHc), since their major phase is of the rhombohedral structure. In an amount of higher than 28 atomic %, on the other hand, no practical permanent magnets are obtained, since the proportion of B-rich nonmagnetic phases is increased, resulting in a drop of residual magnetic flux density (Br). Therefore, the amount of B is limited to a range of 2–28 atomic %. Preferably B is 4–24 atomic %, or more preferably 5–8 atomic %, for higher or highest performance.

Fe (iron) is an inevitable element in the permanent magnet of this invention. An Fe amount of lower than 65 atomic % leads to a drop of residual magnetic flux density (Br) and at least 65 atomic % is preferred. An Fe amount of higher than 80 atomic % gives no further increase in coercive force. Thus, the amount of Fe is preferably 65–80 atomic % in view of the coercive force. Preferably Fe is 74–80 atomic % for higher performance and corrosion resistance.

In the permanent magnet materials of this invention, the substitution of a part of Fe with Co yields magnets having an improved temperature dependence (i.e., less dependent on temperature) without degration of the magnetic properties. However, it is unpreferred that Co exceeds 20 atomic %, since there is then gradual deterioration of magnetic properties. To obtain high residual magnetic flux density, it is most preferred that the amount of Co is in a range of 5–15 atomic % of the total amount of Fe and Co (or the Fe amount before Co substitution).

At least one of the following additional elements M may be added to the R-B-Fe base permanent magnets, since they are effective in improving the coercive force, loop squareness of demagnetization curves and productivity thereof, or cut down the price thereof.

The additional elements M are:

no higher than 9.5 atomic % Al, no higher than 4.5 atomic % Ti;

no higher than 9.5 atomic % V, no higher than 8.5 atomic % Cr;

no higher than 8.0 atomic % Mn, no higher than 5.0 atomic % Bi;

no higher than 9.5 atomic % Nb, no higher than 9.5 atomic % Ta;

no higher than 9.5 atomic % Mo, no higher than 9.5 atomic % W;

no higher than 2.5 atomic % Sb, no higher than 7 atomic % Ge;

no higher than 3.5 atomic % Sn, no higher than 5.5 atomic % Zr;

no higher than 9.0 atomic % Ni, no higher than 9.0 atomic % Si;

no higher than 1.1 atomic % Zn, and no higher than 5.5 atomic % Hf.

However, when two or more of the additional elements are contained, the highest total amount thereof no higher than the atomic % of the element of the additional elements, that is actually added in the largest amount. It is thus possible to enhance the coercive force of the permanent magnets of this invention.

In the production of sintered permanent magnets having excellent magnetic properties from finely divided and uniform alloy powders, it is inevitable that their crystal phase has its major phase (at least 50 vol %, preferably 90 vol % or more, of the overall magnet) consisting of the R-Fe-B or R-(Fe, Co)-B type ferromagnetic compound having a tetragonal crystal structure.

For higher performance it is preferred that the major phase consists of the compound of the tetragonal crystal structure whose average particle size is 1 to 80 μm and further at least 1 vol % (excluding oxide phase) non-magnetic phase is included. The non-magnetic phase is the balance (up to 50 vol % including oxide phase) to the ferromagnetic tetragonal phase.

The permanent magnet according to this invention shows a coercive force iHc of at least 1 kOe, a residual magnetic flux density of at least 4 kG, and a maximum energy product (BH) max of at least 10 MGOe and reaching a high value of 25 MGOe or more.

When R of 50% or more is light rare-earth metals of Nd and/or Pr, the magnet consisting of 12 to 20 atomic % R, 4 to 24 atomic % B and 74 to 80 atomic % Fe provide (BH) max of at least 35 MGOe. In particular, when the light rare earth metal is Nd, (BH) max reaches at least 45 MGOe.

Further, in the present invention, the permanent magnets containing 11 to 15 atomic % Nd, 0.2 to 3.0 atomic % Dy (12 to 17 atomic % Nd and Dy in total R), 5 to 8 atomic % B, 0.5 to 13 atomic % Co, 0.5 to 4 atomic % Al, 1000 ppm or less C, the balance being Fe and impurities to be inevitably entrained from the process of production are preferable as extremely anticorrosive permanent magnets resistant against a corrosion test such that the samples are exposed for 500 hours at a temperature of 80° C. in a relative humidity of 90%.

The permanent magnet materials according to this invention may contain, in addition to R, Fe and B, impurities which are inevitably entrained from the industrial process of production. Such impurities are C, S, Ca, Cl, P, etc., and it is preferred to maintain these impurities no more than 4.0 atomic % in total. Besides, oxygen may be present in certain amounts as oxide.

EXAMPLES

The present invention will be described on the basis of examples and comparative samples.

Example 1

The starting materials used were electrolytic iron of 99.9% purity, a ferroboron alloy containing 19.4% B and Nd, Dy of 99.7% or higher purity. These materials were melted by high-frequency melting to obtain a cast ingot having a composition of 14Nd-0.5Dy-7B-78.5Fe (in atomic %).

Thereafter, the ingot was finely pulveried to obtain fine powders having an average particle size of 3 μm.

The powders were charged into a metal mold of a press machine, oriented in a magnetic field of 12 kOe, and were compacted in the direction parallel with the magnetic field at a pressure of 1.5 t/cm$^2$. The thus obtained compact was sintered at 1100° C. for 2 hours in an Ar atmosphere, and further aged at 800° C. for 1 hour in Ar and then at 630° C. for 1.5 hours in Ar to obtain a sintered permanent magnet body.

Test pieces, each being 12 mm in outer diameter and 2 mm in thickness, were cut out of that sintered body.

The magnetic properties of this permanent magnet test piece were measured and shown in Table 1-1.

The test pieces were dipped for 10 minutes in a toluene in which 0.05 wt % palladium colloids of an about 20 angstroms particle size were dispersed, and the toluene was evaporated to obtain Nd-Dy-B-Fe type permanent magnets which absorbed palladium colloids on the surface thereof.

Further, a nickel chemical plating solution of pH 9.0 containing 0.1 mol/l Ni, 0.15 mol/l soldium hypophosphite, 0.2 mol/l sodium citrate, and 0.5 mol/l anmmonium phosphate was prepared. The Nd-Dy-B-Fe type permanent magnets absorbing palladium colloids were dipped at 80° C. for 60 min in this nickel chemical plating solution, and then washed and dried to obtain permanent magnets having a metallic luster on the surface thereof.

The permanent magnets were analyzed by a ICAP 575 type emission plasma spectral analyzer. The analyzed results were that Pd was 0.01 wt %; Ni was 1.2 wt % for each sample; Pd layer thickness was 55 angstroms; and Ni layer thickness was 5.4 μm.

Table 1-1 shows the magnetic properties of the permanent magnets of the present invention.

The obtained permanent magnets were kept at 80° C. in a 90% reative humidity for 500 hours, and then the magnetic characteristics were measured to check the deterioration. These test results are also shown in Table 1-1.

Example 2

A PdPt alloy film layer of 50 angstroms in thickness is coated on the sintered magnet material body produced by the same composition and the same conditions as in Example 1, by means of ion sputtering in a 0.05 Torr vacuum.

Thereafter, the sintered magnet material bodies coated with the PdPt alloy film layer were electroless-plated under the same Ni plating conditions as in Example 1.

The thickness of the formed Ni plating layer was 5.3 μm and the surface had a metallic luster.

The obtained permanent magnets were kept at 80° C. in a 90% reative humidity for 500 hours, and then the magnetic characteristics were measured to check the deterioration. These test results are also shown in Table 1-1.

Example 3

The sintered magnet material bodies the same as in Example 1 were coated as follows: The sintered magnet material bodies were dipped in a colloidal alumina dispersed in a volatile solvent containing 0.2 wt % of alumina and dried by evapolation, then the resultant coated bodies were dipped for 15 min in a pure aqueous solution in which palladium colloid of about 30 angstroms in particle size was dispersed, and then washed and dried (by evacuation) to obtain Nd-Dy-B-Fe type permanent magnets absorbing palladium colloid.

Further, nickel chemical plating was conducted as in Example 1, and then dried to obtain permanent magnets having a metallic luster on the surface thereof. The analyzed results were that Pd was 0.01 wt %; Ni was 1.5 wt % for each sample; Pd layer thickness was 60 angstroms; and Ni layer thickness was 5.5 μm.

Tables 1-2 and 1-3 show the magnetic properties and the corrosion resistance test results.

COMPARATIVE EXAMPLE

Sintered magnet material bodies obtained by the same composition and the same production conditions as in Example 1 were electroless-plated with Ni under the same plating condition as in Example 1. The thickness of the formed Ni plating was 12 μm, and the surface thereof had a dim metallic luster on the surface thereof.

As a result of the corrosion test at a temperature of 60° C., in a relative humidity of 90%, and for a testing time of 100 hours, the magnetic properties of these comparative sintered magnet material bodies were deteriorated by 10.5% after the testing. The above deterioration proceeded progressively thereafter, and rust was produced on the entire surface of the magnet body after the lapse of 500 hours.

TABLE 1-1

| | Magnetic properties before corrosion resistance test | | | | | | After corrosion resistance test | | | | | |
|---|---|---|---|---|---|---|---|---|---|---|---|---|
| | After aging treatment | | | After surface treatment | | | Magnetic Properties | | | Deterioration rate (%) | | |
| No. | Br (kG) | iHc (kOe) | (BH) max (MGOe) | Br (kG) | iHc (kOe) | (BH) max (MGOe) | Br (kG) | iHc (kOe) | (BH) max (MGOe) | Br (kG) | iHc | (BH) max (MGOe) |
| Example 1 | 11.2 | 15.3 | 30.1 | 11.2 | 15.3 | 30.0 | 11.2 | 14.9 | 28.7 | <1 | 2.6 | 4.7 |
| Example 2 | 11.2 | 15.3 | 30.1 | 11.2 | 15.3 | 30.1 | 11.2 | 14.8 | 28.6 | <1 | 3.3 | 5.0 |

$$\text{Deterioration rate (\%)} = \frac{\text{Mag. properties after aging treatment} - \text{Mag. properties after corr. test}}{\text{Mag. properties after aging treatment}}$$

TABLE 1-2

| | Magnetic properties before corrosion resistance test | | | | | |
|---|---|---|---|---|---|---|
| | After aging treatment | | | After surface treatment | | |
| | Br (kG) | iHc (kOe) | (BH)max (MGOe) | Br (kG) | iHc (kOe) | (BH)max (MGOe) |
| Example 3 | 11.2 | 15.3 | 30.1 | 11.2 | 15.3 | 30.0 |

TABLE 1-3

| | Magnetic properties | | | | | |
|---|---|---|---|---|---|---|
| | After corrosion resistance test | | | Deterioration rate (%) | | |
| | Br (kG) | iHc (kOe) | (BH) max (MGOe) | Br (kG) | iHc (kOe) | (BH) max (MGOe) |
| Example 3 | 11.2 | 14.9 | 28.9 | <1 | 2.6 | 4.0 |

$$\text{Deterioration rate (\%)} = \frac{\text{Mag. properties after aging treatment} - \text{Mag. properties after corr. test}}{\text{Mag. properties after aging treatment}}$$

Example 4

The sintered magnet material bodies the same as in Example 1 were coated with a PdPt alloy film layer by ion sputtering in a 0.05 Torr vacuum.

In addition, the surface of the above test pieces on which the PdPt alloy film layer was coated was further coated with a Ni film layer by vacuum vapor deposition in a $10^{-6}$ Torr vacuum. The obtained sintered magnet material body test pieces had a metallic luster on the surface thereof. The analyzed results showed that Pd was 0.01 wt %; and Ni was 1.2 wt % for each sample;

the thickness of Pd layer was 50 angstroms; and the thickness of Ni layer was 5.0 μm.

Table 2 shows the magnetic properties and the corrosion resistance test results.

Example 5

The sintered magnet material body test pieces the same as in Example 1 were dipped for 10 minutes in a toluene in which palladium colloids of about 20 angstroms particle size were dispersed, and the toluene was evaporated to obtain Nd-Dy-B-Fe type permanent magnets which absorbed palladium colloids on the surface thereof.

In addition, the surface of the above test pieces on which the Pd film layer was coated was further coated with a Ni film layer by vacuum vapor deposition in a $10^{-6}$ Torr vacuum. The obtained sintered magnet material body test pieces had a metallic luster on the surface thereof. The analyzed results showed that Pd was 0.01 wt %; and Ni was 1.5 wt % for each sample; the thickness of Pd layer was 60 angstroms; and the thickness of Ni layer was 5.0 μm.

Table 2 shows the magnetic properties and the corrosion resistance test results of the permanent magnets of the present invention after surface treatment.

Example 6

The sintered magnet material body test pieces the same as in Example 1 were dipped for 10 minutes in 100 cc acetone in which 0.4 g aluminium oxide colloids of an about 200 to 300 angstroms particle size ("Aluminium Oxide C"—Trade Name—made by Nippon Aerosil Co. Ltd.) were dispersed, and the acetone was evaporated to obtain test pieces which absorbed aluminium oxide colloids on the surface thereof.

Consecutively, the above test pieces which absorbed aluminium oxide colloids on the surface thereof were dipped for 15 minutes in a pure aqueous solution in which 0.013 wt % palladium colloids of about 30 angstroms particle size were dispersed, and then washed and dried (by evacuation) to obtain Nd-Dy-B-Fe type permanent magnet test pieces absorbing palladium colloids on the surface thereof.

In addition, the surface of the above test pieces on which palladium was absorbed was further coated with a Ni film layer by vacuum vapor deposition in a $10^{-6}$ Torr vacuum. The obtained sintered magnet material body test pieces had a metallic luster on the surface thereof. The analyzed results showed that Pd was 0.01 wt %; Ni was 1.5 wt % for each sample; the thickness of Pd layer was 60 angstroms; and the thickness of the Ni layer was 5.0 μm.

Table 2 shows the magnetic properties and the corrosion resistance test results of the permanent magnets of the present invention.

Further, Table 2 also shows the external appearance, the magnetic properties, and the magnetic property deterioration rates measured after the above obtained permanent magnets had been kept at 80° C. in a 90% relative humidity for 500 hours.

COMPARATIVE EXAMPLE

Sintered magnet material bodies obtained by the same composition and the same production conditions as in Example 1 were coated with a Ni film layer by vacuum vapor deposition under the same conditions as in Example 4. The surface of the magnet bodies had a dim metallic luster. The thickness of the formed Ni film layer was 5.1 μm.

Table 2 also shows the external appearance, the magnetic properties, and the magnetic property deterioration rates after the above obtained permanent magnets had been kept at 80° C. in a 90% R.H. for 500 hours.

TABLE 2

| | Magnetic properties before corrosion resistance test | | | | | | Magnetic properties after corrosion test | | | | | | Appearance after corrosion resistance test |
|---|---|---|---|---|---|---|---|---|---|---|---|---|---|
| | After aging treatment | | | After surface treatment | | | Magnetic properties | | | Deterioration rate (%) | | | |
| No. | Br (kG) | iHc (kOe) | (BH) max (MGOe) | Br (kG) | iHc (kOe) | (BH) max (MGOe) | Br (kG) | iHc (kOe) | (BH) max (MGOe) | Br (kG) | iHc | (BH) max | |
| Example 4 | 11.2 | 15.3 | 30.1 | 11.2 | 15.3 | 30.0 | 11.2 | 15.0 | 29.7 | <1 | 2.0 | 1.3 | Good without rust |
| Example 5 | 11.2 | 15.3 | 30.1 | 11.2 | 15.3 | 30.0 | 11.2 | 15.1 | 29.5 | <1 | 1.3 | 2.0 | Good without rust |
| Example 6 | 11.2 | 15.3 | 30.1 | 11.2 | 15.3 | 30.0 | 11.2 | 15.0 | 29.6 | <1 | 2.0 | 1.7 | Good without rust |
| Comparison | 11.2 | 15.3 | 30.1 | 11.2 | 15.3 | 30.0 | 11.2 | 14.6 | 28.3 | <1 | 4.6 | 6.0 | Partial rusting at corner edges |

$$\text{Deterioration rate (\%)} = \frac{\text{Mag. properties after aging treatment} - \text{Mag. properties after corr. test}}{\text{Mag. properties after aging treatment}}$$

Example 7

The starting materials used were electrolytic iron of 99.9% purity, a ferroboron alloy containing 19.4% B and Nd, Dy, Co and Al of 99.7% or higher purity. These materials were melted by high-frequency melting to obtain a cast ingot having a composition of 14Nd-0.5Dy-7B-6Co-1.5Al-71Fe (in atomic %).

Thereafter, the ingot was finely pulverized to obtain fine powders having an average particle size of 3 μm.

The powders were charged into a metal mold of a press machine, aligned in a magnetic field of 12 kOe, and were compacted in the direction parallel with the magnetic field at a pressure of 1.5 t/cm$^2$. The thus obtained compact was sintered at 1100° C. 2 hours in Ar, and further aged at 800° C. for 1 hour in Ar to obtain a sintered permanent magnet body.

Test pieces, each being 12 mm in outer diameter, and 2 mm in thickness, were cut out of that sintered body.

The test pieces were dipped for 10 minutes in a pH 8.3 aqueous solution in which 0.013 wt % palladium colloids of about 20 angstroms particle size were dispersed to obtain Nd-Dy-B-Co-Al-Fe type permanent magnet which absorbed palladium colloids on the surface thereof.

Further, a nickel chemical plating solution of pH 9.0 containing 0.1 mol/l Ni, 0.15 mol/l sodium hypophosphite, 0.2 mol/l sodium citrate, and 0.5 mol/l anmmonium phosphate was prepared. The Nd-Dy-B-Co-Al-Fe type permanent magnets absorbing palladium colloids were dipped at 80° C. for 60 minutes in this chemical plating solution, and then washed and dried to obtain permanent magnets having a metallic luster on the surface thereof.

The permanent magnets were analyzed by a ICAP 575 type emission plasma spectral analyzer. The analyzed results showed that Pd was 0.01 wt %; and Ni was 1.2 wt % for each sample; Pd layer thickness was 55 angstroms; and Ni layer thickness was 5.4 μm. Besides the interdiffusion layers were measured and turned out as follows: 30000 angstroms thick interdiffusion layer of Nd and Fe in the Ni layer; and 12000 angstroms thick interdiffusion layer of Ni in the sintered body.

These permanent magnets were diffusion-heat-treated at 570° C. for 1.5 hour in Ar. The measured magnetic properties are shown in Table 3.

Thereafter, the thus obtained permanent magnets of the present invention were kept at 125° C. in a 85% R.H. for 12 hours to measure the adhesiveness and the bonding strength of the coated film layers. These measured results are shown in Table 3. The adhesiveness test was made by a mesh peeling-off test after the humidity resistance test, and the bonding strength test conformed to JIS 6852.

Example 8

A PdPt alloy film layer of 50 angstroms in thickness was coated on the sintered magnet material bodies produced by the same composition and the same conditions as in Example 7 by means of ion sputtering in a 0.05 Torr vacuum.

Thereafter, the sintered magnet material bodies coated with the PdPt alloy film layer were electroless-plated under the same Ni plating conditions as in Example 7.

The thickness of the formed Ni plating layer was 5.3 μm and the surface had a metallic luster.

Thereafter, these permanent magnets were diffusion-heat-treated at 570° C. for 1.5 hours in Ar. The measured magnetic properties are shown in Table 3. Thereafter, the obtained permanent magnets of the present invention were kept at 125° C. in a 85% R.H. for 12 hours to measure the adhesiveness and the bonding strength of the coated film. Table 3 shows these test results. In Table 3, the mark "O" indicates that peeled-off areas per 2 mm pitch—100 mesh square areas are less than 1/10 of the entire areas and "X" indicates that peeled-off area per 2 mm pitch—100 mesh square areas are more than 1/10 of the entire areas.

COMPARATIVE EXAMPLE

The same Pd layer and Ni layer as in Example 7 were formed on the sintered magnet material bodies produced by the same composition and the same conditions, by means of the same method as in Example 7 except that a second step aging treatment at 570° C. for 1.5 hours is conducted after the first aging treatment and that the diffusion heat treatment is not conducted.

The thus obtained comparative sintered magnet material bodies were kept at 125° C. in 85% for 12 hours to measure the adhesiveness and the bonding strength of the coated film. Table 3 shows these test results.

TABLE 3

| | Magnetic properties after diffusion | | | Oxidation resistant film | |
|---|---|---|---|---|---|
| | Br (kG) | iHc (kOe) | (BH)max (MGOe) | Adhesiveness | Bonding strength |
| Example 7 | 11.3 | 12.9 | 30.3 | O | 50 kg/cm$^2$ or more |
| Example 8 | 11.3 | 12.8 | 30.3 | O | 50 kg/cm$^2$ or more |
| Comparison | 11.2 | 12.8 | 30.2 | X | 10 kg/cm$^2$ or less |

As clarified in Tables 1 to 3 which indicate the magnetic properties before and after corrosion resistance tests, the deterioration rates of these magnetic properties, adhesive force and the external appearance, the permanent magnets of the present invention have such futures that the deterioration from the initial magnetic properties is small; the corrosion resistance is excellent; and the stability of magnetic property is further improved.

We claim:

1. A corrosion-resistant permanent magnet comprising a sintered body consisting essentially of 10 to 30 atomic % R wherein R is at least one element selected from the group consisting of Nd, Pr, Dy, Ho and Tb or a mixture of said at least one element and at least one selected from the group consisting of La, Ce, Sm, Gd, Er, Eu, Tm, Yb, Lu and Y, 2 to 28 atomic % B and 65 to 80 atomic % Fe; and having a major phase of a tetragonal crystal structure; the surface of the sintered body being coated with a noble metal film layer consisting essentially of at least one noble metal selected from the group consisting of Pd, Ag, Pt, Au and alloys thereof and a base metal film layer, disposed on said noble metal layer, consisting essentially of at least one base metal selected from the group consisting of Ni, Cu, Sn, Al, Cr, Zn, Co and alloys thereof; said corrosion resistant permanent magnet being characterized by a deterioration rate of the initial magnetic properties thereof being 10% or less after having been kept at a temperature of 80° C. in a relative humidity of 90% for 500 hours.

2. A corrosion-resistant permanent magnet comprising a sintered body consisting essentially of 10 to 30 atomic % R wherein R is at least one element selected from the group consisting of Nd, Pr, Dy, Ho and Tb or a mixture of said at least one element and at least one selected from the group consisting of La, Ce, Sm, Gd, Er, Eu, Tm, Yb, Lu and Y, 2 to 28 atomic % B and 65 to 80 atomic % Fe; and having a major phase of a tetragonal crystal structure; the surface of the sintered body being coated with a noble metal film layer consisting essentially of at least one noble metal selected from the group consisting of Pd, Ag, Pt, Au and alloys thereof and a base film layer, disposed on said noble metal layer, consisting essentially of at least one base metal selected from the group consisting of Ni, Cu, Sn, Al, Cr, Zn, Co and alloys thereof; interdiffusion layers being formed between said base metal layer and said sintered body; said corrosion-resistant permanent magnet being characterized by a deterioration rate of the initial magnetic properties thereof being 10% or less after having been kept at a temperature of 80° C. in a relative humidity of 90% for 500 hours, and the adhesion properties of the metal film layers being stable after having been kept at a temperature of 125° C. in a relative humidity of 85% for 12 hours.

3. The corrosion-resistant permanent magnet as defined in claim 1 or 2, wherein said noble metal film layer has a thickness of 10 to 100 angstroms.

4. The corrosion-resistant permanent magnet as defined in claim 1 or 2, wherein said base metal film layer has a thickness of 25 μm or less.

5. The corrosion-resistant permanent magnet as defined in claim 4, wherein said base metal film layer has a thickness of 3 to 20 μm.

6. The corrosion-resistant permanent magnet as defined in claim 2, wherein Fe and rare earth elements R contained in the sintered body forms a 50–50000 angstroms thick diffusion layer in the base metal layer; and the base metal forms a 50–50000 angstroms thick diffusion layer in the sintered body.

7. The corrosion-resistant permanent magnet as defined in claim 6, wherein Fe and rare earth elements R contained in the sintered body forms a 30000 angstroms or less thick diffusion layer in the base metal layer; and the base metal forms a 30000 angstroms or less thick diffusion layer in the sintered body.

8. The corrosion-resistant permanent magnet as defined in claim 1 or 2, wherein said base metal is at least one selected from the group consisting of Ni, Cu, Sn and Co.

9. The corrosion-resistant permanent magnet as defined in claim 1 or 2, wherein no more than 20 atomic % of Fe in the sintered body is substituted by Co.

10. The corrosion-resistant permanent magnet as defined in claim 1 or 2, wherein said sintered body further comprises at least one of additional elements M in an amount no more than the value specified below:

9.5 atomic % Al, 4.5 atomic % Ti;
9.5 atomic % V, 8.5 atomic % Cr;
8.0 atomic % Mn, 5.0 atomic % Bi;
9.5 atomic % Nb, 9.5 atomic % Ta;
9.5 atomic % Mo, 9.5 atomic % W;
2.5 atomic % Sb, 7 atomic % Ge;
3.5 atomic % Sn, 5.5 atomic % Zr;
9.0 atomic % Ni, 9.0 atomic % Si;
1.1 atomic % Zn, and 5.5 atomic % Hf;

provided that, when two or more of the additional elements are contained, the highest total amount thereof is no higher than the atomic % of the additional element that is actually added in the largest amount.

11. The corrosion-resistant permanent magnet as defined in claim 1 or 2, wherein at least 50 atomic percent of the total rare earth elements R is Nd and/or Pr.

12. The corrosion-resistant permanent magnet as defined in claim 11, wherein the rare earth element R in the sintered body is 12–20 atomic %, B is 4–24 atomic % and Fe is 74–80 atomic %.

13. The corrosion-resistant permanent magnet as defined in claim 12, wherein for R in the sintered body, Nd is 11–15 atomic %, Dy is 0.2–3.0 atomic % and sum of Nd and Dy is 12–17 atomic %; B is 5–8 atomic %; and the sintered body further includes 0.5–13 atomic % Co and 0.5–4 atomic % Al.

14. The corrosion-resistant permanent magnet as defined in claim 13, wherein C is present in an amount of no more than 1000 ppm.

* * * * *